US009085878B2

(12) United States Patent
Anderson

(10) Patent No.: US 9,085,878 B2
(45) Date of Patent: Jul. 21, 2015

(54) FREEZE PROOF SANITARY YARD HYDRANT

(71) Applicant: Merrill Manufacturing Company, Storm Lake, IA (US)

(72) Inventor: Stephen J Anderson, Storm Lake, IA (US)

(73) Assignee: Merrill Manufacturing Company, Storm Lake, IA (US)

( * ) Notice: Subject to any disclaimer, the term of this patent is extended or adjusted under 35 U.S.C. 154(b) by 132 days.

(21) Appl. No.: 14/076,862

(22) Filed: Nov. 11, 2013

(65) Prior Publication Data

US 2015/0129052 A1 May 14, 2015

(51) Int. Cl.
*E03B 9/04* (2006.01)
*E03B 9/14* (2006.01)

(52) U.S. Cl.
CPC ... *E03B 9/14* (2013.01); *E03B 9/04* (2013.01); *Y10T 137/538* (2015.04); *Y10T 137/5333* (2015.04)

(58) Field of Classification Search
CPC ..... E03B 9/04; E03B 9/14; E03B 9/02
USPC ..... 137/73, 281, 282, 291, 292, 301, 304, 137/599.11
See application file for complete search history.

(56) References Cited

U.S. PATENT DOCUMENTS

| | | | | |
|---|---|---|---|---|
| 3,885,585 | A * | 5/1975 | Carpentier | 137/282 |
| 4,109,671 | A * | 8/1978 | Hughes et al. | 137/282 |
| 4,112,966 | A * | 9/1978 | Carlson | 137/282 |
| 4,854,339 | A * | 8/1989 | Hoeptner, III | 137/282 |
| 5,033,500 | A * | 7/1991 | Hoeptner, III | 137/282 |
| 5,246,028 | A | 9/1993 | Vandepas | |
| 5,261,441 | A | 11/1993 | Anderson | |
| 5,701,925 | A | 12/1997 | Mulligan et al. | |
| 5,797,421 | A * | 8/1998 | Merrett | 137/236.1 |
| 6,948,509 | B1 * | 9/2005 | Ball et al. | 137/1 |
| 7,234,479 | B2 * | 6/2007 | Murdock | 137/1 |
| 8,408,238 | B1 | 4/2013 | Anderson | |
| 8,474,476 | B2 * | 7/2013 | Ball et al. | 137/301 |
| 2011/0220208 | A1 * | 9/2011 | Ball et al. | 137/1 |

OTHER PUBLICATIONS 2-pgs Freezeless/Pollution-Proof Yard Hydrant, MODEL S2 by Woodford Manufacturing Company, Jul. 1995.
2-pgs Backflow Protected Automatic Draining Freezeless Sanitary Yard Hydrant, MODEL S3 by Woodford Manufacturing Company, Nov. 1999.
7 pages NA-9000 Series Sanitary Yard Hydrant by Merrill Manufacturing Company.

* cited by examiner

*Primary Examiner* — Craig Schneider
*Assistant Examiner* — Kevin Barss
(74) *Attorney, Agent, or Firm* — Sturm & Fix LLP

(57) ABSTRACT

A yard hydrant, including a discharge nozzle above ground level, connects to other vertically reciprocal working parts in the ground below the frost line. A water storage chamber, disposed below the frost line, is formed in part by a deformable diaphragm. Residual water in the hydrant, when the hydrant is turned off, is collected in the water storage chamber and returned to the hydrant for discharge through the nozzle when the hydrant is turned on. A venturi disposed in the water supply line creates turbulence and thereby creates a lower pressure adjacent the exit of the venturi when the hydrant is turned on. This lowered pressure at the venturi exit speeds up the evacuation of water from the water storage chamber when the hydrant is on so the storage chamber can accept and store water that would otherwise be above the frost line when the hydrant is turned off.

4 Claims, 6 Drawing Sheets

FREEZE PROOF SANITARY YARD HYDRANT

TECHNICAL FIELD

This invention relates generally to yard hydrants and more particularly to yard hydrants that, when shut off, drain the water in a standpipe or riser down to a level below the frost line into a closed system instead of draining that standpipe/riser water into the ground below or surrounding the supply pipe.

BACKGROUND

A yard hydrant conventionally includes a discharge nozzle above ground level connected to a standpipe or riser that extends into the ground below the frost line to well known working parts connected to a source of water supply under pressure. When water flow is turned off, residual water within the hydrant is subject to freezing at freezing temperatures. To avoid such freezing, a common expedient has been to provide a "drain hole" below the frost line so the water will drain out into the surrounding ground when the hydrant is turned off. A disadvantage of such a drain hole is the fact that it is also a way for reentry of water into the hydrant which intermixes with other water passing there through. Under such conditions, there is the possibility of contamination of the hydrant water from impure seepage which, if it occurs, can contaminate the water supply. For this reason, many city and rural water supply organizations have regulations prohibiting the use of the aforementioned old "drain hole" technology.

Accordingly, in the hydrant art, structures have been developed which eliminate the drain hole and substitute some form of a storage reservoir/storage chamber structure below the frost line whereby the residual water can be contained and stored below the frost line and subsequently be discharged above ground level the next time the yard hydrant is used to supply water above ground. U.S. Pat. No. 5,261,441 to Anderson and U.S. Pat. No. 5,246,028 to Vandepas and U.S. Pat. No. 5,701,925 to Mulligan et al. show such solutions for sanitary yard hydrants that drain to a reservoir under the frost line instead of using the older drain hole technology. All of the aforementioned patents are incorporated herein by reference in their entirety.

The yard hydrant shown in U.S. Pat. No. 5,246,028 to Vandepas uses a Venturi to siphon water out of the storage chamber but the Venturi only works to pull water from the storage chamber when the hydrant is "full on". The Venturi needs such high water flow velocity in order to create the siphon necessary to pull the water out of the storage chamber. Because of this situation, the hydrant must be left on for a minute or two each time it is turned on to allow the Venturi to siphon/empty the storage chamber so the storage chamber has enough room to store water from the standpipe/riser each time the water is turned off.

In farm and ranch environments, hydrants are mostly turned on long for a long enough time that the aforementioned problem of getting adequate velocity of the water to make the Venturi work to siphon out the stored water in the storage chamber would not be a problem. But especially in places where members of the public can use a yard hydrant, people will only turn the hydrant on, like for any other faucet, for only the water they need, which quite often is not be enough time for the Venturi to drain the storage chamber, thus leaving water in the standpipe/riser to freeze. The typical use of a hydrant by member of the public that needs only gallon or less of water might mean that that person only turns on a hydrant for less than thirty seconds at a time, which is not enough time for the Venturi to drain the storage chamber in the yard hydrant shown in U.S. Pat. No. 5,246,028 to Vandepas, for example. Since it only takes one time during freezing conditions for the water in the standpipe/riser to not drain and freeze, this is a major problem.

U.S. Pat. No. 5,701,925 to Mulligan et al. was apparently developed, at least in part, to solve the problem discussed above with respect to the yard hydrant shown in U.S. Pat. No. 5,246,028 to Vandepas. In the Mulligan et al. device a second main outlet port was added to allow full flow when the hydrant is first turned on so the venturi will work to siphon out the storage chamber. But this Mulligan et al. design needs an additional component, a vacuum breaker back flow preventer, to be added so flow can be diverted from the second outlet to the first primary main outlet where a hose can be connected. Adequate functioning water flow time through the venturi to create a siphon is still critical in this Mulligan et al. design.

In all of the aforementioned prior art designs, if the water is not allowed to flow freely out the standpipe/riser for an adequate amount of time, the storage chamber will not be emptied, and the next time the yard hydrant is used, the water in the standpipe/riser will have no place to go and will be left above the frost line to freeze.

Accordingly there is a need for a method and apparatus for emptying the storage chamber faster than storage chambers are emptied in prior art sanitary yard hydrants to prevent such hydrants from freezing.

BRIEF DESCRIPTION OF THE DRAWINGS

The above identified problems are at least partially solved through provision of the method and apparatus described in the following detailed description, particularly when studied in conjunction with the drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
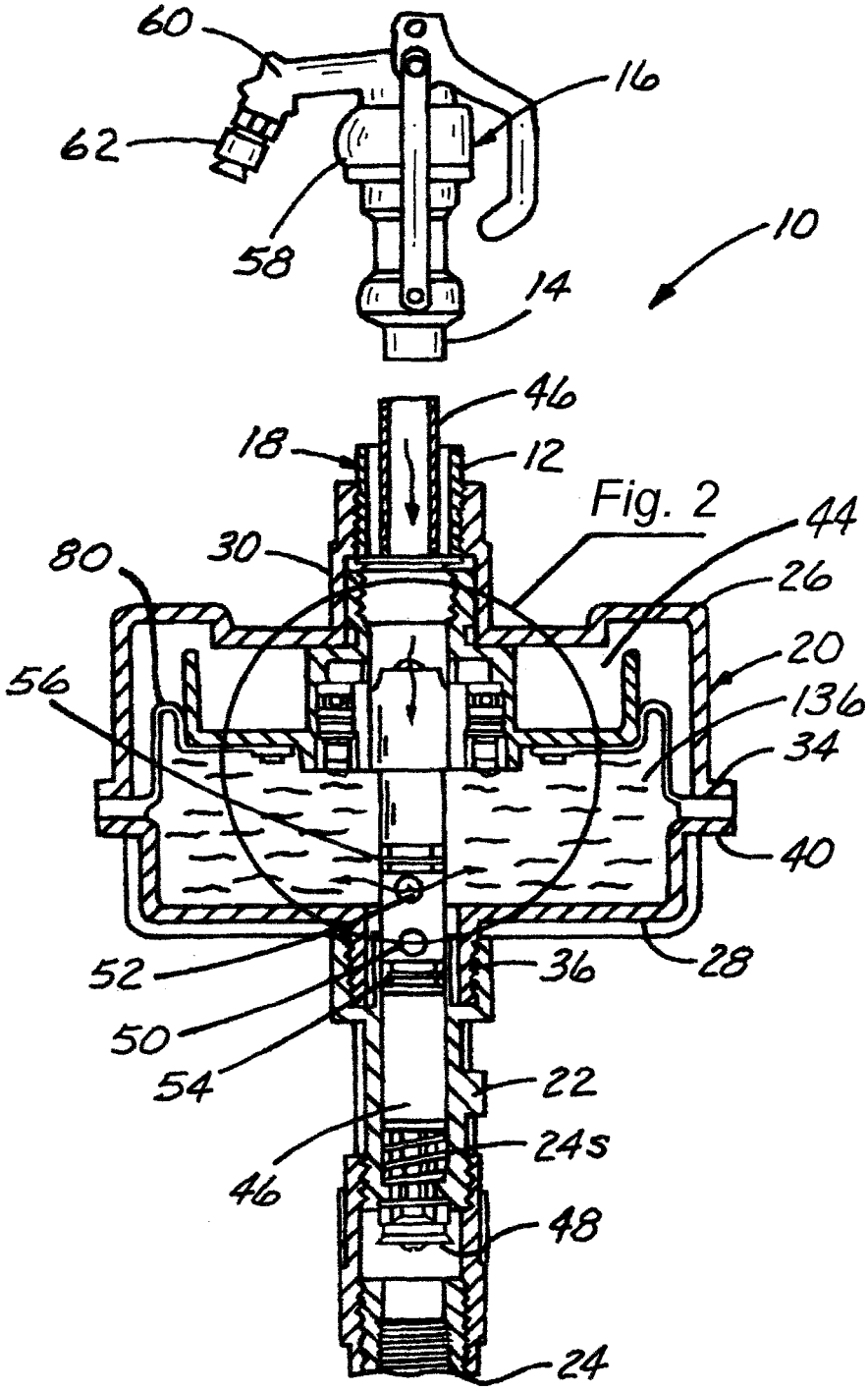
FIG. 1 is a cross sectional view of a yard hydrant constructed in accordance with the present invention with the main valve from the water supply closed and the water draining from the standpipe/riser above the ground into a storage reservoir below the frost line.

Referring now to the drawings wherein like reference numerals designate identical or corresponding parts throughout the several views, FIG. 1 shows a hydrant 10 with an elongated outer casing 12 having its upper end 14 above ground level attached to a head section 16, and its lower end 18 extending into the ground below the frost line for axial attachment to a cylindrical water storage reservoir unit 20. The storage reservoir 20, sometimes referred to herein as a water storage chamber 20, is axially attached to a valve body housing 22 adapted for connection to a source of water supply under pressure through pipe 24. This hydrant 10 can be just like the hydrant shown in U.S. Pat. No. 5,261,441 to Anderson except there is an additional element, a venturi 136, the advantage of which will be explained below.

The water storage reservoir unit 20 has the complementary upper inverted cup-shaped member 26 and the lower cup-shaped member 28. Member 26 has the upstanding axial neck 30 that is internally threaded in its upper portion to which the lower end 18 of casing 12 is threadably attached. The bottom of member 26 terminates in the peripheral flange 34. Member 28 has the depending axial externally threaded neck 36. The upper end of the valve body 22 is threadably attached to neck 36 and the lower end thereof is operatively attached to pipe 24 that is connected to a source of water supply (not shown) under pressure in a well known manner. A diaphragm 80 is clamped around its outer periphery between peripheral flange 40 of housing part 28 and flange 34 of upper member 26 by a plurality of spaced bolts and nuts, not shown, to form the internal chamber 44 of above the diaphragm of unit 20 in conjunction with housing part 28. A storage chamber 136 is thereby formed below the diaphragm 80 as shown in FIGS. 1-7.

Thus far described, there is provided a through passageway from pipe 24 through the valve body housing 22, through the reservoir unit 20 and casing 12 to the head section 16, and the operating parts for water flow control there through and water storage in unit 20 are described as follows.

An elongated water pipe 46, having an upper, intermediate and lower section as will appear, is disposed in casing 12 for reciprocation therein and extending from the head section 16 through unit 20 into the valve body housing 22 for engagement with the plunger valve 48 at the bottom of said housing. The lower section of pipe 46 has the lower water port 50 and the upper water port 52 with a pair of 0-rings 54 below port 50 and a like pair 56 above port 52. The reciprocation of pipe 46 between closed position (FIG. 1) and open position (FIG. 3) is as follows.

Head section 16 includes a hollow body portion 58 having an integral nozzle 60 with a water passageway therein. The upper end of pipe 46 is threadably attached to body portion 58 in fluid communication with the passageway inside of nozzle 60. A head guide is threadably secured to the upper end 14 of casing 12 to extend upwardly therefrom and head section 16 is journalled on said guide for vertical reciprocation.

Within chamber 44 of the reservoir unit 20, the diaphragm 80 removably secured to the water pipe 46 and vertically movable therewith when pipe 46 is moved between up and down, to and from open and closed positions. Chamber 44 is vented, for example in the way shown in U.S. Pat. No. 5,261,441 to Anderson, so that the diaphragm 80 can move between the extreme positions shown in FIGS. 1 and 6.

Figure 2:
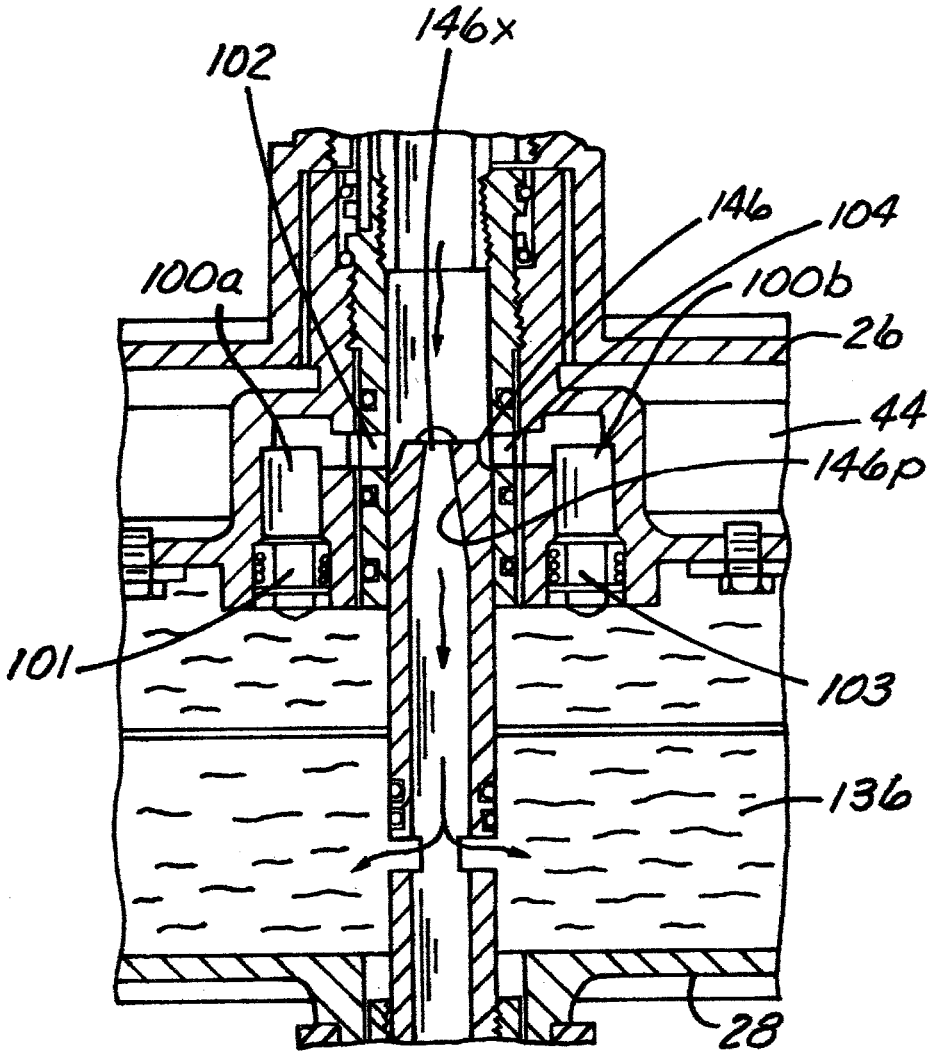
FIG. 2 is an enlarged view of the portion within the circle 2 of FIG. 1.

Looking to FIG. 2, the venturi 146 at the top of pipe 46 can be one piece with pipe 46, or the venturi 146 can be a separate piece attached to pipe 46. The venturi 146 is of course tapered from being wider at the bottom of the passageway thereof to the outlet 146*x* thereof. The purposed of the venturi 146 is to cause turbulence (shown in dashed lines 102*t* and 104*t* in FIG. 5) at the outlet 146*x*, thereby lowering the pressure around and above the outlet 146*x* so that when water is flowing through one way check valves 101 and 103 up to the pipe 46, the pressure will be lower at ports 102 and 104 than the pressure would be at ports 102 and 104 if the venturi 146 was not there. (It is to be understood that the one way check valves will not allow water to flow down there through, only up as shown in FIGS. 1-7.) This lowered pressure 102*t* and 104*t*, adjacent ports 102 and 104, speeds up the flow of water out of the storage chamber 136 below diaphragm 80 in the FIGS. 3-7 configuration when the main hydrant 10 valve 48 is turned on. That way, even if water is taken from the hydrant 10 for even a very short time, the likelihood that all of the water in storage chamber 136 will be evacuated is increased significantly compared to not having the venturi 146 there at all.

Figure 3:
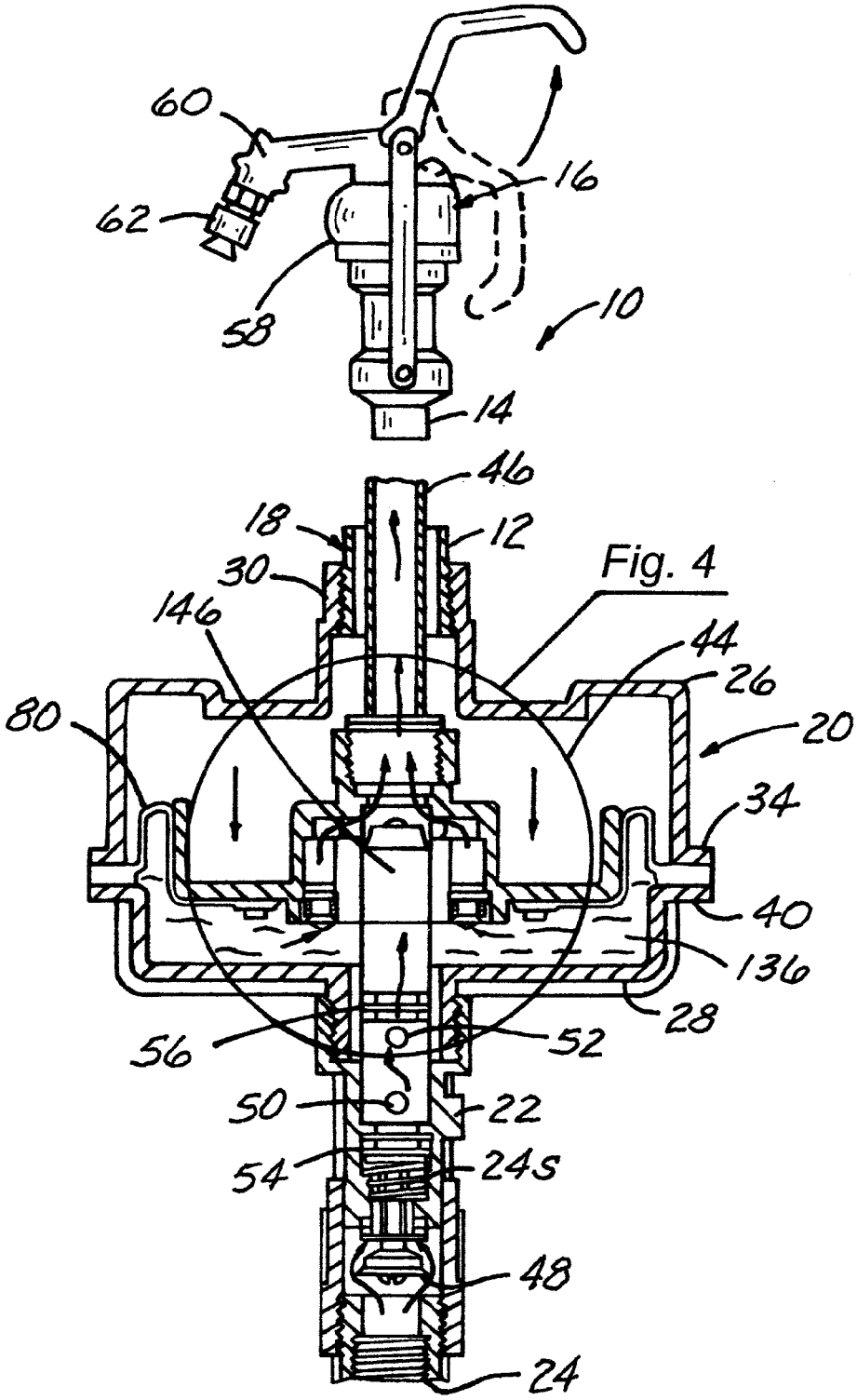
FIG. 3 is a cross sectional view of the yard hydrant of FIG. 1 with the main valve from the water supply open and the water entering the standpipe/riser above the ground to the yard hydrant outlet, while at the same time the water in the a storage reservoir below the frost line is being drained, showing the storage reservoir about half drained.
Figure 4:
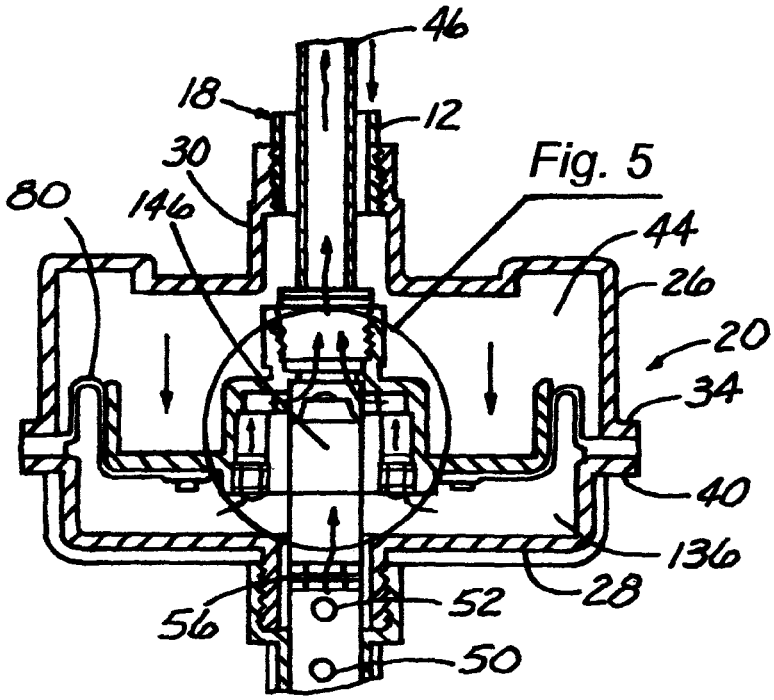
FIG. 4 is an enlarged view of the portion within the circle 4 of FIG. 3.
Figure 5:
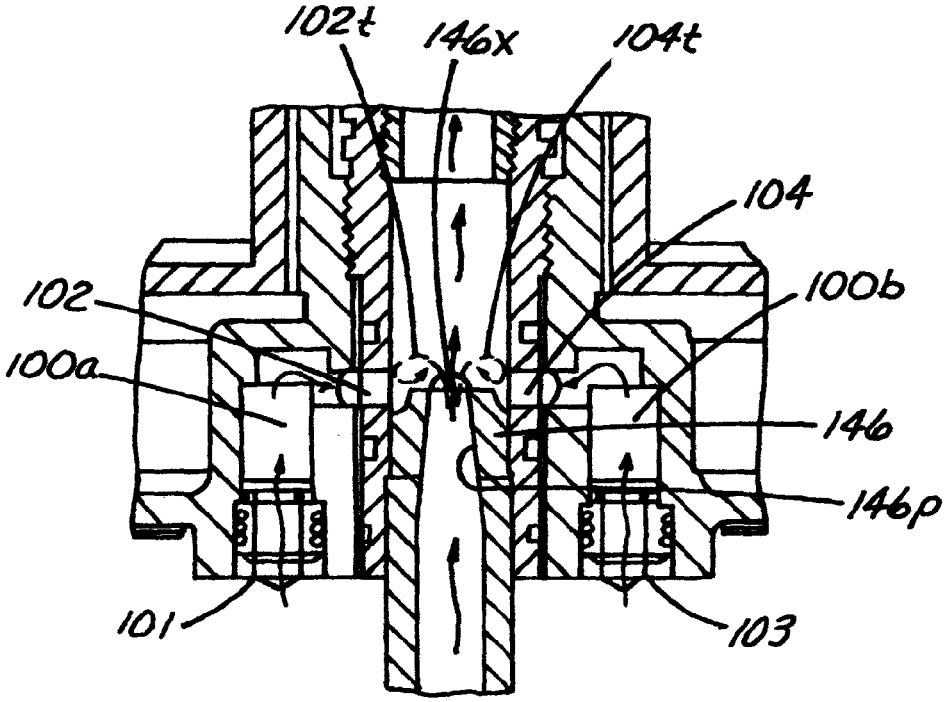
FIG. 5 is an enlarged view of the portion within the circle of FIG. 4 and showing in dashed lines a lower pressure being developed due to the turbulence caused by a venturi at the outlet of the venturi.

In operation, the "on" position of hydrant 10 (FIGS. 3-7) is obtained by lifting the handle from the dashed line position shown in FIG. 3 to the solid line position of FIG. 3, which results in pressing head section 16 downwardly, which moves the water pipe 46 into engagement with the plunger check valve 48 (which is biased closed by spring 24*s* to allow water to flow from pipe 24 through pipe 46 to nozzle 62 in a well known manner. U.S. Pat. No. 8,408,238 to Anderson, incorporated herein by reference, shows how this handle part of the hydrant can work.

Figure 6:
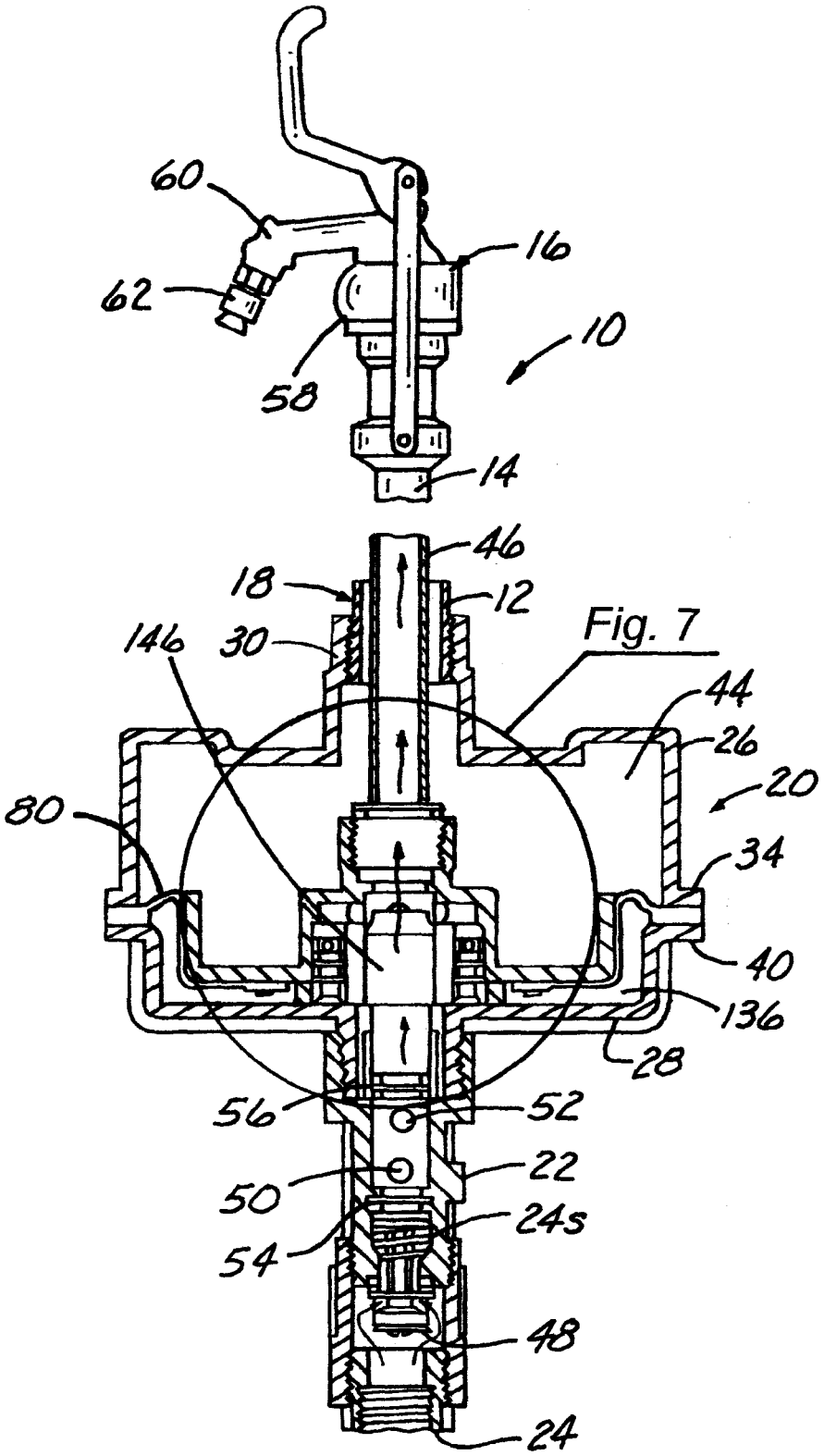
FIG. 6 is a cross sectional view of the yard hydrant like in FIG. 3 with the main valve from the water supply open and the water entering the standpipe/riser above the ground to the yard hydrant outlet, while at the same time the water in the a storage reservoir below the frost line is being drained, showing the storage reservoir almost completely drained.
Figure 7:
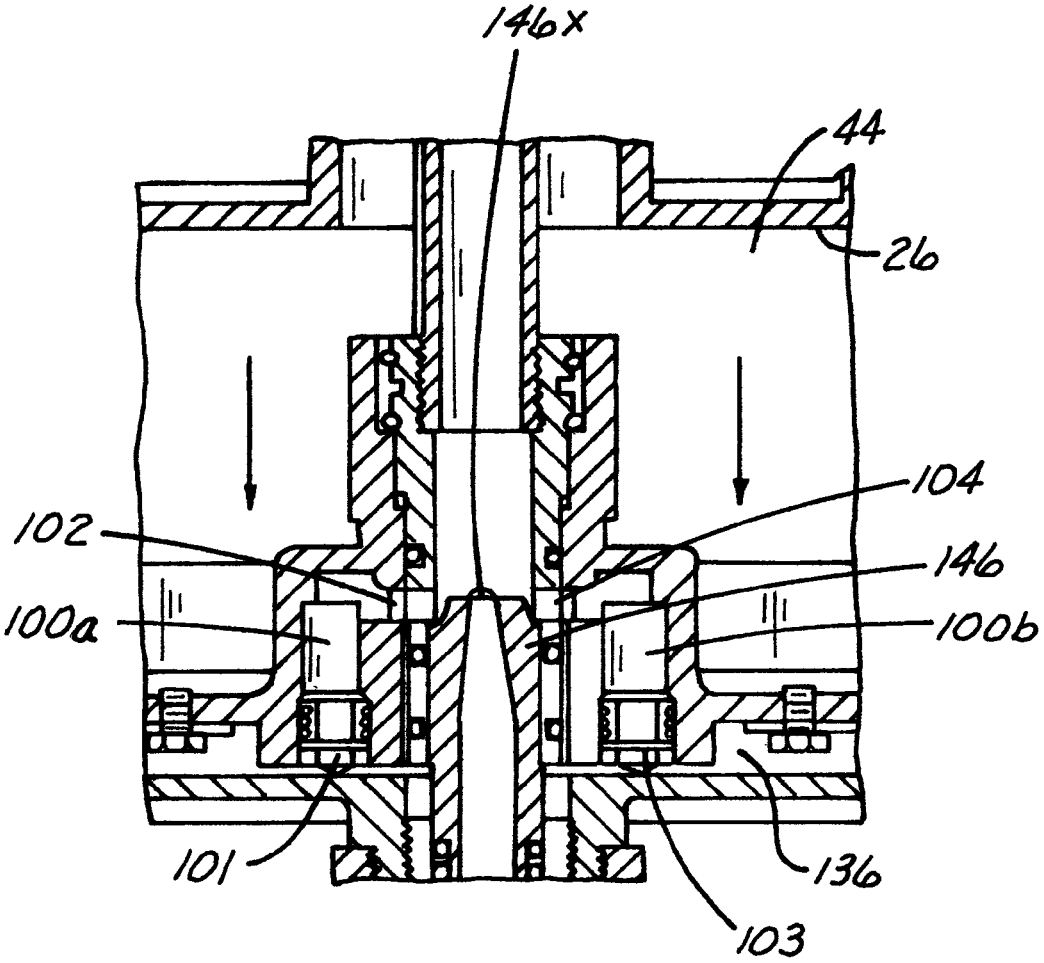
FIG. 7 is an enlarged view of the portion within the circle 7 of FIG. 6.

In the position of FIGS. 6 and 7, the diaphragm assembly 80 is at its lowest point within chamber 44 and the water storage area 136 is at its smallest dimension. Also, the upper port 52 in pipe 46 has descended into the depending neck 36 of section 28 and by reason of 0-rings 56 and, accordingly, area 136 is sealed off from any water system pressure. The "closed" position of hydrant 10 (FIGS. 1 and 2) is obtained by closing the handle to the FIG. 1 position which results in raising head section 16, whereby pipe 46 moves out of contact with the plunger check valve 48 to close water flow from pipe 24. This movement causes diaphragm 80 to move upwardly with pipe 46 to begin the enlargement of the water storage area 136. Such enlargement begins to occur prior to the movement of port 52 into area 136 and during this interval, to fill the void created under diaphragm 80. When port 52 enters area 136, water in pipe 46, no longer under pressure, flows down pipe 46 out of port 52 into such area 136 which has expanded to accommodate and store such residual water without danger of pollution.

When hydrant 10 is next moved to "on" position as shown in FIG. 3, the diaphragm 80 is moved downwardly correspondingly and while port 52 remains within area 136, water will flow into port 52 into pipe 46 and when port 52 has descended into neck 36 of section 28 so as to be out of flow communication with area 136, substantially all of the remaining water in such area will flow through the check valves 101 and 103 through passageways 100/102/104 into pipe 46 for discharge out of nozzle 62 with the new flow from pipe 24 as discussed above, with the Venturi 146 significantly speeding up the process of evacuation of the water from chamber 136 as discussed above.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept as expressed by the attached claims.

I claim:

1. A sanitary yard hydrant, comprising, an elongated pipe having upper and lower ends, said lower end being adapted for connection to a source of water under pressure and the upper end being adapted to be in fluid communication with an above ground outlet of water from the source of water;

a control valve operatively connected to said pipe to control the flow of fluid in said pipe and being operable between open and closed positions;

a water storage chamber adapted to be disposed below the frost line;

a drain port associated with said pipe for allowing fluid in said pipe above said drain port to drain downwardly and outwardly from said pipe into the storage chamber when the control valve is closed;

a passageway between the storage chamber and an opening port in the pipe above the drain port;

a one way check valve disposed in the passageway for permitting flow from the storage chamber to the pipe when the control valve is open but not permitting flow from the pipe to the storage chamber;

a venturi disposed in the pipe, the venturi having a fluid passage opening which tapers from a first size at a bottom portion thereof to a smaller size at a top portion thereof, the top portion of the venturi forming a venturi exit when the control valve is open so that water can flow through the control valve, through the pipe, through the venturi, and out the above ground outlet; and the opening port in the pipe above the drain hole being adjacent the exit of the venturi so that turbulence caused by the venturi at the venturi exit when the control valve is open will create a lowered pressure at the opening port in the pipe above the drain hole, thereby creating a greater pressure difference between pressure of the water in the storage chamber and the pressure at the opening port in the pipe adjacent the exit of the venturi when the control valve is open than the pressure difference would be between the pressure in the storage chamber and the pressure at the opening port if the venturi was not present when the control valve is open.

2. The yard hydrant of claim 1 wherein the storage chamber includes a diaphragm operatively attached to the pipe, the diaphragm and pipe having a first raised position corresponding to the control valve being in the closed position and second lowered position corresponding to the control valve being in an open position.

3. The yard hydrant of claim 2 wherein the control valve is operatively attached to the pipe and moves up and down as the pipe moves between the first raised position and the second lowered position.

4. The yard hydrant of claim 2 wherein the diaphragm within said water storage chamber provides a watertight expandable water storage area on one side of the diaphragm, the diaphragm being secured to the water pipe for reciprocation therewith.

* * * * *